US008419347B2

(12) United States Patent
Pomfret

(10) Patent No.: US 8,419,347 B2
(45) Date of Patent: Apr. 16, 2013

(54) FLUID PUMP

(75) Inventor: Colin Thomas Pomfret, Barford (GB)

(73) Assignee: Godiva Limited, Warwick (GB)

( * ) Notice: Subject to any disclaimer, the term of this patent is extended or adjusted under 35 U.S.C. 154(b) by 760 days.

(21) Appl. No.: 12/531,741

(22) PCT Filed: Mar. 10, 2008

(86) PCT No.: PCT/GB2008/050167

§ 371 (c)(1),
(2), (4) Date: Jan. 18, 2010

(87) PCT Pub. No.: WO2008/114045

PCT Pub. Date: Sep. 25, 2008

(65) Prior Publication Data

US 2010/0143106 A1 Jun. 10, 2010

(30) Foreign Application Priority Data

Mar. 20, 2007 (EP) ..... 07104469

(51) Int. Cl.
*F04D 9/00* (2006.01)

(52) U.S. Cl.
USPC ..... 415/56.1; 415/170.1; 415/199.1; 415/206

(58) Field of Classification Search ..... 415/199.1, 415/199.2, 170.1, 206, 56.5, 58.2, 56.1
See application file for complete search history.

(56) References Cited

U.S. PATENT DOCUMENTS

| | | | | |
|---|---|---|---|---|
| 1,840,257 | A | 1/1932 | Saxe | |
| 2,882,075 | A * | 4/1959 | Biering et al. | 277/368 |
| 3,213,798 | A * | 10/1965 | Carswell | 415/175 |
| 3,698,830 | A * | 10/1972 | Goyne | 415/111 |
| 4,035,104 | A | 7/1977 | Buse | |
| 4,335,886 | A * | 6/1982 | Frey et al. | 277/412 |

* cited by examiner

*Primary Examiner* — Ninh H Nguyen
(74) *Attorney, Agent, or Firm* — Gordon & Jacobson, PC

(57) ABSTRACT

A fluid pump comprising a pump body, a low pressure impeller, a high pressure impeller, impeller seal means separating the inlet side of the low pressure impeller from its pressure side, a pump priming system, and a pump priming conduit provided through the low pressure impeller radially inboard of the impeller seal means. The high pressure impeller is preferably provided within a cavity, defined by an impeller recess and a cover plate. A wear ring is preferably provided between the low pressure impeller and the inboard end of the cover plate. The pump priming conduit preferably comprises: first and second axial bores through the pump body; a radial bore and two axial holes through the cover plate; an axial hole through the rear wear ring; a cavity between the wear ring and the low pressure impeller; and axial holes through the low pressure impeller, connecting the cavity to the suction side of the low pressure impeller.

18 Claims, 4 Drawing Sheets

FLUID PUMP

BACKGROUND OF THE INVENTION

1. Field of the Invention

The invention relates to a fluid pump having a pump priming system.

2. State of the Art

Most existing water pumps are primed by extracting the air from the pump from the top of the pump suction tube. This has historically been the accepted as the best position from which to prime a pump since it is fairly close to the centre line of the pump and hence away from the pressure side of the impeller into which the water is centrifuged. However, when the pump is partially primed with part water and part air there is a tendency for water in the suction tube to start to rotate due to the motion of the impeller. This water then tends to enter the priming port, along with any remaining air, causing it to be sent through the priming system, thereby reducing its efficiency. This then extends the "hand over" time, the time between water entering the pump and the pump generating pressure, and sometimes results in unacceptably large quantities of water passing through the priming system.

When priming a pump from the conventional top of the suction tube position there are many occasions when water is drawn into the priming system in addition to air. The relatively large quantities of water being pulled into the priming system can result in consequently longer priming times, higher loads being imposed on priming components, higher wear and higher corrosion due to the water presence. There is therefore a need for there to be a reduced volume of water passed into the priming system and a quicker conversion from the unprimed to the primed condition.

A solution which has been proposed when priming a pump from the top of the suction tube is to provide disrupter blades within the suction tube, to prevent the water in the suction tube from rotating. Although this solution has had some success it is not very effective.

Another proposed solution has been to locate the priming port within the pump body, towards the top and rear of the low pressure impeller, on the pressure side of the impeller. However, this has the disadvantage that the pump is not being primed from an area of suction pressure, which results in a relatively long hand over time.

SUMMARY OF THE INVENTION

According to an aspect of the present invention there is provided a fluid pump comprising:

a pump body;

a fluid inlet;

a first impeller;

impeller seal means provided on the pressure side of the first impeller between the first impeller and the pump body; and a pump priming system;

and characterized by further comprising a pump priming conduit extending from the inlet, suction, side of the first impeller, through the impeller, and through the pump body to the pump priming system, the pump priming conduit being provided through the first impeller radially inboard of the impeller seal means, the impeller seal means separating the inlet side of the impeller from its pressure side.

Connecting the pump priming system to an area of the pump inboard of the low pressure impeller seal provides a quicker and more positive prime than is possible connecting to the standard top of suction tube position.

The impeller seal means preferably comprises a rear wear ring provided on the pressure side of the first impeller, between the pump body and the impeller. The pump priming conduit preferably further extends through the rear wear ring.

The point where air is extracted from the pump is thereby as far inboard as possible and inside the rear wear ring. Taking priming air from this position results in an almost instantaneous hand over from unprimed to primed condition. This in turn results in only very small quantities of water entering the priming system with subsequent reduced loading in the priming system, reduced wear and quicker priming times to generate pressure.

The fluid pump preferably further comprises a second impeller mounted for axial rotation and provided after the first impeller. Preferably, the first impeller is a low pressure impeller and the second impeller is a high pressure impeller. The second impeller is preferably a regenerative high pressure impeller. The second impeller is preferably provided within an impeller cavity defined by an impeller recess provided within the pump body and a cover plate. The rear wear ring is preferably provided between the first impeller and part of the cover plate.

Preferably, the high pressure impeller facing faces of the impeller recess and the cover plate are provided with fluid channels around which fluid flows as its pressure is raised by the high pressure impeller. The fluid channels are preferably part-annular in shape, preferably extending in a part circular path from approximately 15 degrees to approximately 345 degrees.

The pump priming conduit preferably extends through the cover plate. The pump priming conduit preferably extends axially into the cover plate from one side, then radially outwards through the cover plate, and axially out of the cover plate on its other side. Preferably, the pump priming conduit extends axially out of the cover plate on its other side between the ends of the cover plate fluid channel.

Routing the pump priming conduit through the cover plate enables the point where air is extracted from the pump to remain as far inboard as possible, and inside the rear wear ring.

Embodiments of the invention will now be described in detail, by way of example only, with reference to the accompanying drawings.

DETAILED DESCRIPTION OF THE PREFERRED EMBODIMENT

Figure 1:
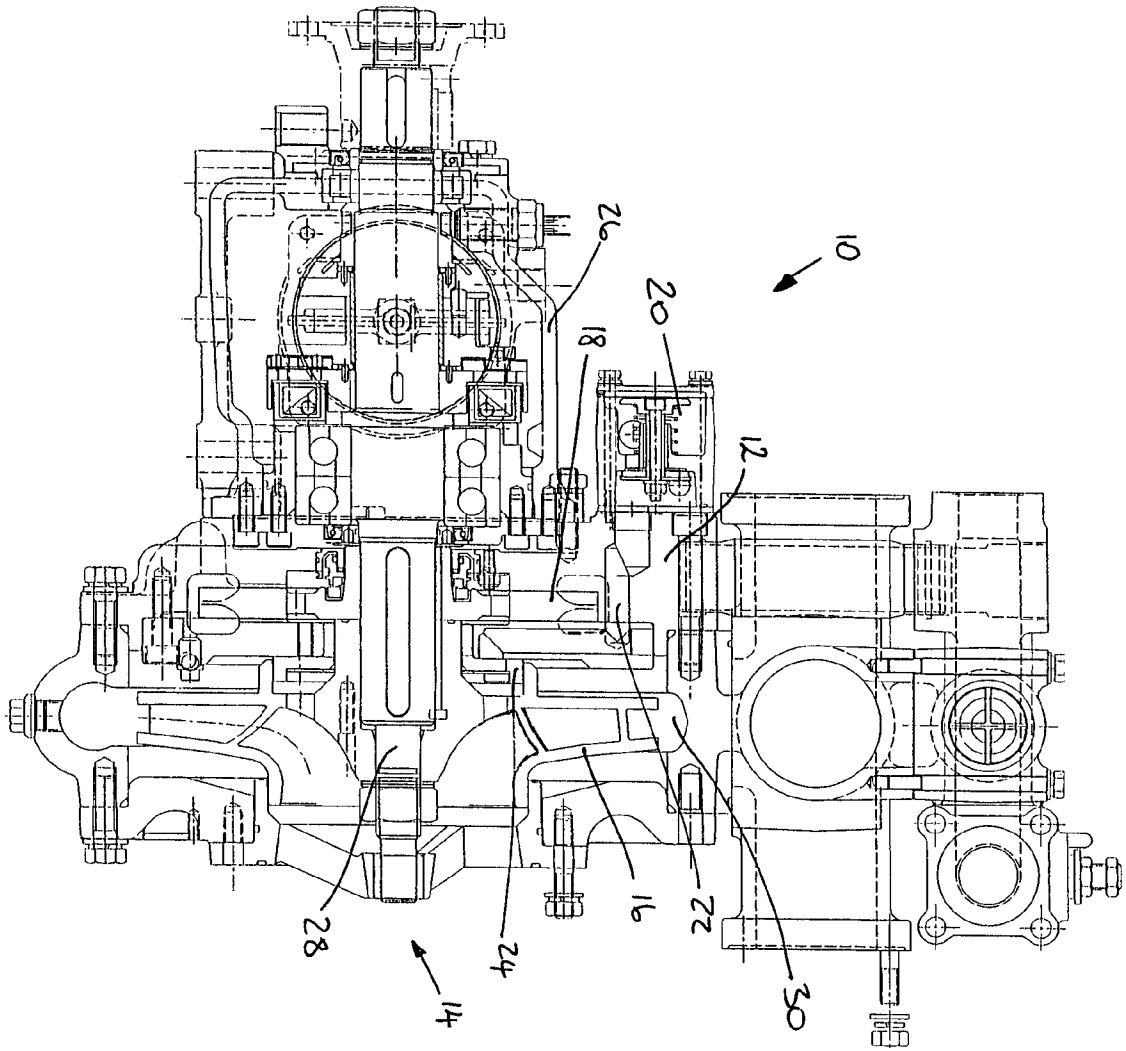
FIG. 1 is a diagrammatic sectional view of part of a dual pressure water pump according to a first embodiment of the invention.
Figure 2:
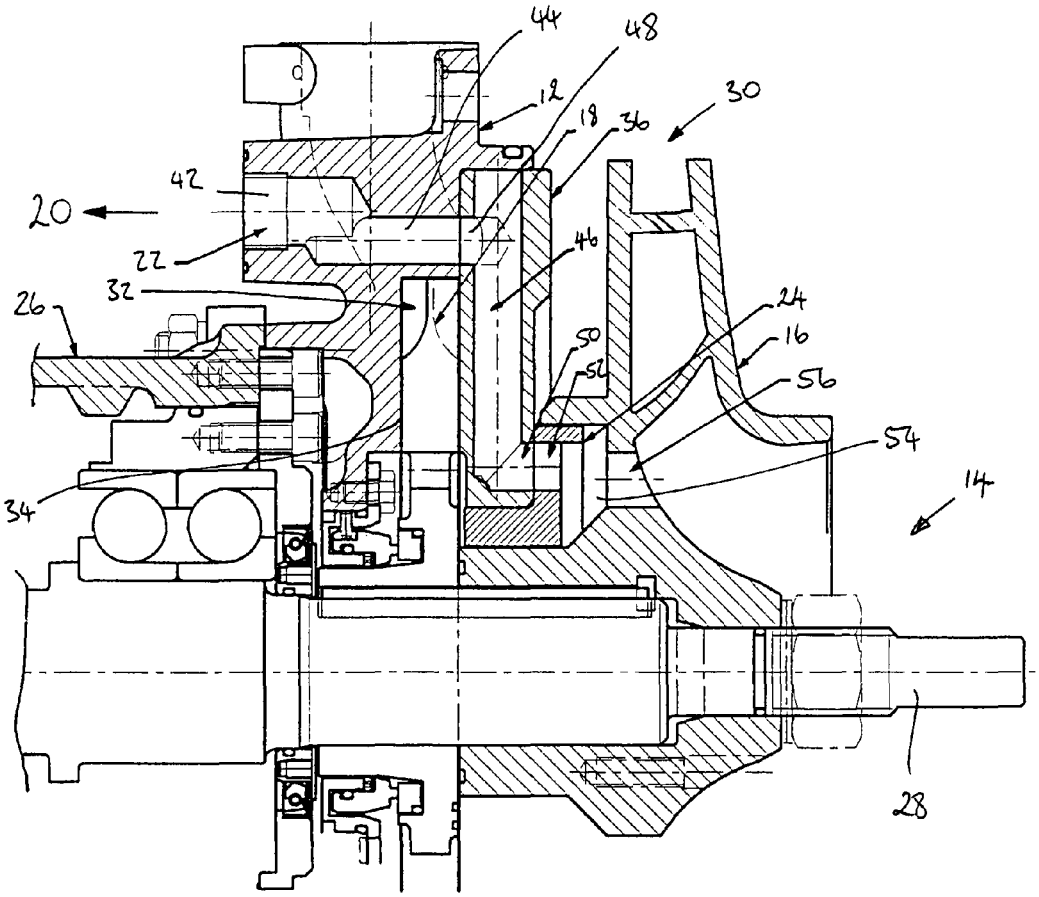
FIG. 2 is an enlarged view of part of FIG. 1.
Figure 3:
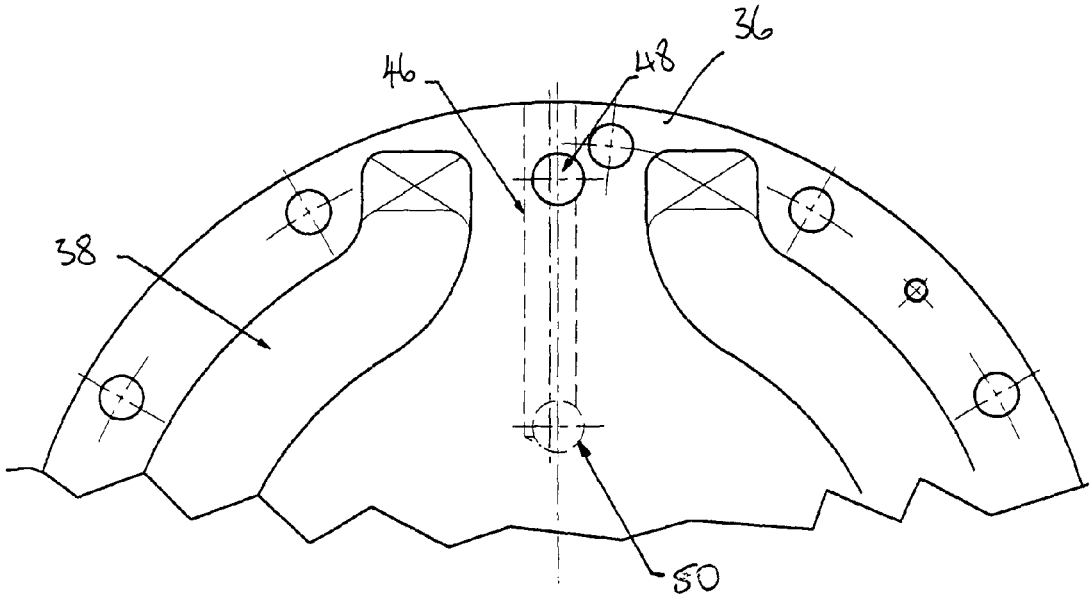
FIG. 3 is a diagrammatic representation of part of the high pressure impeller facing face of the cover plate of FIG. 1.

Referring to FIGS. 1 to 3, a first embodiment of the invention provides a dual pressure water pump 10 comprising a pump body 12, a fluid inlet (shown generally at 14), a first, low pressure, impeller 16, a second, high pressure, impeller 18, a pump priming system 20, a pump priming conduit 22 and a rear wear ring 24.

The pump body 12 is bolted onto a pump bearing housing 26, in which the pump motor (not shown) is provided for driving a pump shaft 28 to which the impellers 16, 18 are coupled.

The low pressure impeller 16 is provided within a first impeller cavity 30 defined by the pump body 12. The high pressure impeller 18 is provided within a second impeller cavity 32, defined by an impeller recess 34 formed in the pump body 12 and a cover plate 36. The high pressure impeller 18 closely fits within the impeller recess 34.

The high pressure impeller facing faces 34*a*, 36*a* of the impeller recess 34 and the cover plate 36 have water channels 38 provided in them, as shown in FIG. 3, around which water spirals as it is driven through the high pressure impeller 18 and its pressure is raised. The water channels 38 are part-annular in shape and extend in part circular paths around the cover plate 36 and the impeller recess 34. The water channels 38 paths extend part-circularly from approximately 15 degrees to approximately 345 degrees (approximately 12.30 to 11.30 on a circular clock face), with a gap 40 being provided between the water inlet 38*a* and water outlet 38*b* ends of the channels 38. This gap 40 allows the water inlet 38*a* to be positively separated from the water outlet 38*b*.

The rear wear ring 24 is provided between the low pressure impeller 16 and the inboard end of the high pressure impeller cover plate 36.

The pump priming system 20 of this example comprises a piston primer of a type which will be well known the person skilled in the art and so will not be described in detail here.

The pump priming conduit 22 comprises several sections, as follows. The first section is provided through the pump body 12 and comprises first and second interconnecting axial bores 42, 44. At their distal ends the first bore 42 is coupled to the pump priming system 20 and the second bore 44 is coupled to the second section of the pump priming conduit 22.

The second section of the pump priming conduit 22 is provided through the high pressure impeller cover plate 36 and comprises a radial bore 46 and two axial holes 48, 50. The radial bore extends from the edge of the cover plate 36 towards its middle, through the section of the cover plate at the gap 40 between the ends of the water channel 38. The outer end of the radial bore 46 is blanked off by part of the pump body 12, or can alternatively be blanked of with a blanking plug.

The first axial hole 48 extends from the high pressure impeller side of the cover plate 36, through the gap 40, to the radial bore 46, and couples to the distal end of the second axial bore 44 in the pump body 12. The second axial hole 50 extends from the other side of the cover plate 36, at a position towards the centre of the cover plate 36, through the cover plate 36 to the bottom of the radial bore 46. The second axial hole 50 is coupled to the third section of the pump priming conduit 22.

The third section of the pump priming conduit 22 extends through the rear wear ring 24, and comprises an axial hole 52 provided through the rear wear ring 24. The axial hole is coupled at one side to the axial hole 50 and at its other side to the fourth section of the pump priming conduit 22, which comprises a cavity 54 between the rear wear ring 24 and the low pressure impeller 16.

The fourth section of the pump priming conduit 22 extends through the low pressure impeller 16 and comprises a number of axial holes 56 provided through the low pressure impeller 16, connecting the cavity 54 to the suction side of the low pressure impeller 16. The axial holes 56 also act to balance the pressure across the low pressure impeller 16. The rear wear ring 24 separates the suction side of the low pressure impeller 16 from its pressure side.

The pump priming conduit 22 thereby connects the rear of the pump body 12, connected to the priming system 20, to the cavity space inboard of the rear wear ring 24 of the low pressure impeller 16. The connecting axial holes 56 in the low pressure impeller 16 connect the cavity 54, where priming occurs, to a pump suction tube (not shown) coupled to the inlet 14.

In use, the pump priming system 20 draws air out of the pump 10, causing water within a pump suction tube coupled to the inlet 14 to rise up into the pump 10. When the pump 10 is almost primed, with the low pressure impeller 16 partially filled with water, the centrifugal force of the impeller 16 throws the water outwards and the air remaining within the pump 10 collects towards the centre of the impeller 16 from where it is taken through the pump priming conduit 22 to the priming system 20.

Figure 4:
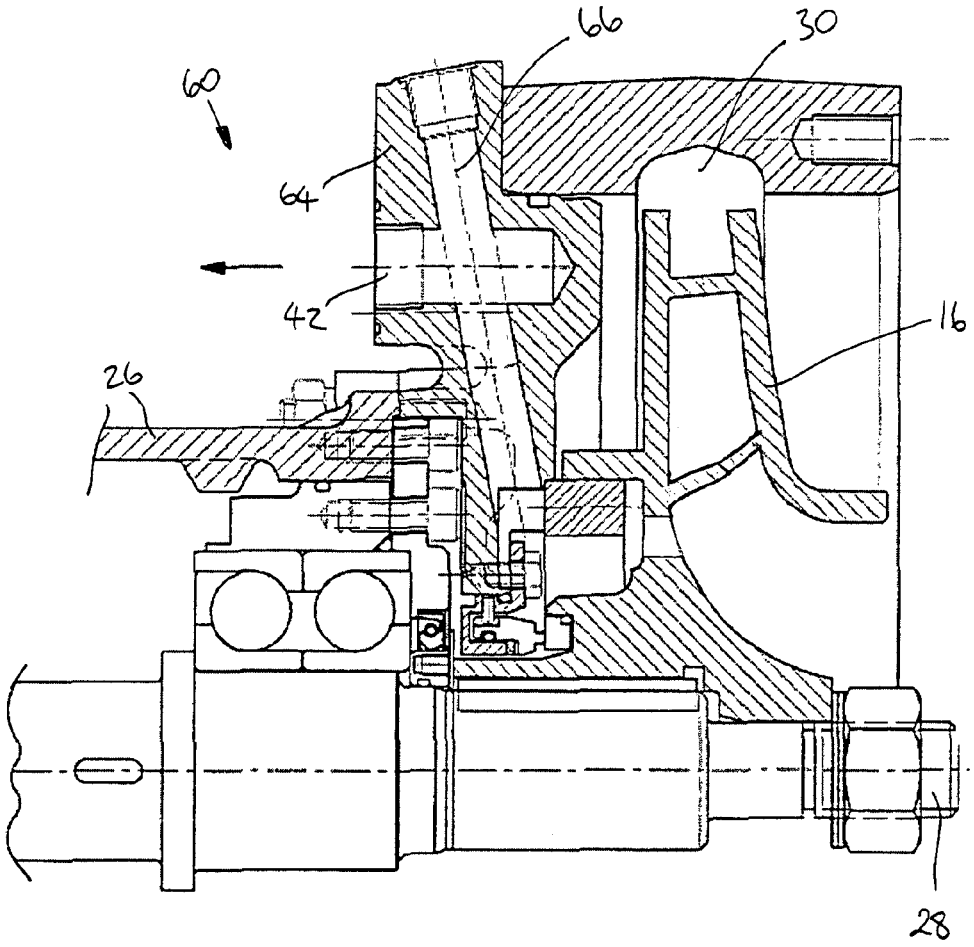
FIG. 4 is a diagrammatic sectional view of part of a single pressure water pump according to a second embodiment of the invention.

FIG. 4 shows a single pressure water pump 60 according to a second embodiment of the invention. The single pressure water pump 60 is substantially the same as the dual pressure water pump 10 of the first embodiment, but only has a low pressure impeller 16 and the following consequential modifications. The same reference numbers are retained for corresponding features.

In this embodiment, the rear wear ring 62 is provided between the low pressure impeller 16 and the pump body 64.

The first section of the pump priming conduit 22, extending through the pump body 64, comprises a first axial bore 42 and a second, generally radial bore 66 extending at an angle downwards from the top of the pump body 64, through the axial bore 42, towards the middle of the pump body 64 where it meets the rear wear ring 62. The bottom of the radial bore 66 is coupled to an axial hole 68 provided through the rear wear ring 62. The axial hole 68 is coupled to the cavity 54 between the rear wear ring 62 and the low pressure impeller 16.

Various modifications may be made without departing from the scope of the present invention. The impellers may be of a different size and type to those described. The pump priming conduit may follow a different path from the pump priming system to the rear of the low pressure impeller to those described.

The described embodiments provide various advantages, as follows. Connecting the pump priming system to an area of the pump inboard of the low pressure impeller seal, in these examples, within the diameter of the rear wear ring, provides a quicker and more positive prime than is possible connecting to the standard top of suction tube position. The point where air is extracted from the pump is as far inboard as possible and inside the rear wear ring. Taking priming air from this position results in an almost instantaneous hand over from unprimed to primed condition. This in turn results in only very small quantities of water entering the priming system with subsequent reduced loading in the priming system, reduced wear and quicker time to pressure generation.

The invention claimed is:

1. A fluid pump comprising:

a pump body;

a fluid inlet;

a first impeller;

impeller seal means provided on the pressure side of the first impeller between the first impeller and the pump body;

a pump priming system; and a pump priming conduit extending from the inlet, suction, side of the first impeller, through the first impeller, and through the pump body to the pump priming system, the pump priming conduit being provided through the first impeller radially inboard of the impeller seal means, the impeller seal means separating the inlet side of the first impeller from its pressure side.

2. A fluid pump as claimed in claim 1, wherein the impeller seal means comprises a rear wear ring provided on the pressure side of the first impeller between the pump body and the first impeller, and the pump priming conduit extends through the rear wear ring.

3. A fluid pump as claimed in claim 1, wherein the fluid pump further comprises a second impeller mounted for axial rotation and provided after the first impeller.

4. A fluid pump as claimed in claim 3, wherein the first impeller is a low pressure impeller and the second impeller is a high pressure impeller.

5. A fluid pump as claimed in claim 3, wherein the second impeller is provided within an impeller cavity defined by an impeller recess provided within the pump body and a cover plate.

6. A fluid pump as claimed in claim 5, wherein faces of the impeller recess that face the second impeller and the cover plate are provided with fluid channels around which fluid flows as its pressure is raised by the second pressure impeller.

7. A fluid pump as claimed in claim 6, wherein the fluid channels are part-annular in shape, extending in a part circular path from approximately 15 degrees to approximately 345 degrees.

8. A fluid pump as claimed in claim 7, wherein the pump priming conduit extends through the cover plate.

9. A fluid pump as claimed in claim 8, wherein the pump priming conduit extends axially into the cover plate from one side, then radially outwards through the cover plate, and axially out of the cover plate on its other side.

10. A fluid pump as claimed in claim 9, wherein the pump priming conduit extends axially out of the cover plate on its other side between the ends of the cover plate fluid channel.

11. A fluid pump comprising:

a pump body;

a fluid inlet;

a first impeller;

impeller seal means provided on the pressure side of the first impeller between the first impeller and the pump body;

a pump priming system; and a pump priming conduit extending from the inlet, suction, side of the first impeller, through the first impeller, and through the pump body to the pump priming system, the pump priming conduit being provided through the first impeller radially inboard of the impeller seal means, the impeller seal means separating the inlet side of the first impeller from its pressure side;

wherein the impeller seal means comprises a rear wear ring provided on the pressure side of the first impeller between the pump body and the first impeller, and the pump priming conduit extends through the rear wear ring.

12. A fluid pump as claimed in claim 11, wherein the pump priming conduit extends through a cover plate defining at least one fluid channel.

13. A fluid pump as claimed in claim 12, wherein the pump priming conduit extends axially into the cover plate from one side, then radially outwards through the cover plate, and axially out of the cover plate on its other side.

14. A fluid pump as claimed in claim 12, wherein the pump priming conduit extends axially out of the cover plate on its other side between the ends of the cover plate fluid channel.

15. A fluid pump comprising:

a pump body;

a fluid inlet;

a first impeller;

a second impeller mounted for axial rotation and provided after the first impeller;

impeller seal means provided on the pressure side of the first impeller between the first impeller and the pump body;

a pump priming system; and a pump priming conduit extending from the inlet, suction, side of the first impeller, through the first impeller, and through the pump body to the pump priming system, the pump priming conduit being provided through the first impeller radially inboard of the impeller seal means, the impeller seal means separating the inlet side of the first impeller from its pressure side;

wherein the first impeller is a low pressure impeller and the second impeller is a high pressure impeller.

16. A fluid pump as claimed in claim 15, wherein the second impeller is provided within an impeller cavity defined by an impeller recess provided within the pump body and a cover plate.

17. A fluid pump as claimed in claim 16, wherein faces of the impeller recess that face the second impeller and the cover plate are provided with fluid channels around which fluid flows as its pressure is raised by the second pressure impeller.

18. A fluid pump as claimed in claim 17, wherein the fluid channels are part-annular in shape, extending in a part circular path from approximately 15 degrees to approximately 345 degrees.

* * * * *